US007771605B2

(12) United States Patent
Karapatis

(10) Patent No.: US 7,771,605 B2
(45) Date of Patent: Aug. 10, 2010

(54) LASER MARKING METHOD

(75) Inventor: Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 427 days.

(21) Appl. No.: 11/777,398

(22) Filed: Jul. 13, 2007

(65) Prior Publication Data

US 2008/0014370 A1 Jan. 17, 2008

(30) Foreign Application Priority Data

Jul. 13, 2006 (EP) ..... 06117094

(51) Int. Cl.
*B44C 1/22* (2006.01)

(52) U.S. Cl. ..... 216/63; 216/65; 216/94

(58) Field of Classification Search ..... 216/63, 216/65, 94
See application file for complete search history.

(56) References Cited

U.S. PATENT DOCUMENTS 4,743,463 A * 5/1988 Ronn et al. ..... 427/597
5,987,920 A * 11/1999 Bosman et al. ..... 65/23
6,442,974 B1 * 9/2002 Paananen et al. ..... 65/30.13

FOREIGN PATENT DOCUMENTS

DE 40 22 745 A1 1/1992
DE 196 52 253 A1 6/1998
WO 95/25639 9/1995

OTHER PUBLICATIONS

European Search Report issued in corresponding application No. EP 06 11 7094, completed Sep. 29, 2006.

* cited by examiner

*Primary Examiner*—Binh X Tran
(74) *Attorney, Agent, or Firm*—Griffin & Szipl, P.C.

(57) ABSTRACT

The invention concerns a method of marking an article using a laser emitting radiation of wavelength λ, the article being formed of a material that is slightly absorbent at said wavelength λ, characterized in that it includes the following main steps:

taking a support formed of a metal that is highly absorbent at wavelength λ and capable of converting at least in part the light energy absorbed into thermal energy, arranging the article directly against the support so as to form a sufficient thermal contact between the article and the support to transfer the thermal energy from the support to the article, the article being inserted between the laser and the support, locally illuminating said support through said article in conditions able to generate, at the surface of the support, sufficient thermal energy for the thermal energy transfer from the support to the article to produce on the surface of the article a local physical or chemical transformation resulting in a contrast at the origin of the marking.

4 Claims, 1 Drawing Sheet

LASER MARKING METHOD

This application claims priority from European Patent Application No. 06117094.0, filed Jul. 13, 2006, the entire disclosure of which is incorporated herein by reference.

FIELD OF THE INVENTION

The present invention relates to the field of laser marking. It concerns more specifically a method for laser marking a material that is transparent at the laser wavelength.

BACKGROUND OF THE INVENTION

Laser marking of various materials is very widespread in numerous industries. It is used, for example for marking a serial number, a barcode, a logo etc. . . . The Nd:YAG laser, which is compact and relatively inexpensive, is widely used. Its wavelength of 1064 nm can mark absorbent materials in infrared, such as metals and some plastics or ceramics. However, there exists a range of materials that are transparent at 1064 nm, for which the use of the Nd:YAG laser is impossible. One solution for these materials is to use a frequency multiplier for obtaining radiation at 355 nm, i.e. in ultraviolet. This solution is, however, expensive, cumbersome and unfavourable from the point of view of energy consumption. For this reason, it is preferable to avoid it.

Of the materials that are transparent at 1064 nm, some are liable to transform physically or chemically via the effect of a rise in temperature of the order of grandeur of that produced by laser pulses (typically several tens to several hundred degrees Kelvin). Plexiglas or PMMA (poly methylmethacrylate) is a material of this type. Transparent in the visible range, it has good mechanical properties, such that it is often employed as a replacement for glass, for numerous applications.

Since Plexiglas is slightly absorbent at 1064 nm, several solutions already exist for marking it. Marking at 355 nm, referred to previously, suffers from the aforecited drawbacks. Another method consists in introducing pigments that are photosensitive at 1064 nm into the Plexiglas mass. This solution, however, increases the manufacturing cost of the Plexiglas. Finally, mechanical etching by milling takes a long time and is ill suited to mass marking.

A first alternative to these methods is disclosed in U.S. Pat. No. 5,987,920. This Patent discloses a laser marking method for an article made of a slightly absorbent material using a highly absorbent assisting material of the ceramic type. Said absorbent material is deposited as a sacrificial layer on a support that comes into contact with the article to be etched, or directly on one surface of the article to be etched. Via the effect of the laser illumination, the absorbent material is sprayed and the debris generated are projected against the surface to be marked, which increases the roughness thereof and generates the effect of marking. This method is complex and expensive as it requires depositing a layer of absorbent material on the surface of the article to be marked, then removing it. If a support is used, the lifetime of the support is limited since the sacrificial layer degenerates after several uses. The surface sacrificial layer on the support must be regularly renewed so that the method does not lose efficiency.

U.S. Pat. No. 4,743,463, moreover, discloses a method of marking an article of slightly absorbent material, using a highly absorbent material such as metal. A metal plate, or a sheet of metal is brought into contact with the article to be marked, then illuminated by a laser so as to spray said metal locally, and to redeposit it on the article. Marking is thus obtained by transferring material from the plate to the article. The drawback of this method is the low resistance of the marking to wear and friction.

SUMMARY OF THE INVENTION

The present invention overcomes these drawbacks by proposing a simple and economic alternative to the various methods of marking materials such as Plexiglas, which are slightly absorbent at 1064 nm. It concerns more particularly a method of marking an article using a laser emitting a ray of wavelength λ, the article being formed by a material slightly absorbent at wavelength λ, characterized in that it includes the following main steps:

- taking a support formed of a metal that is highly absorbent at wavelength λ, and capable of converting at least part of the light energy absorbed into thermal energy,
- arranging the article directly against the support in order to achieve sufficient thermal contact between the article and the support to transfer thermal energy from the support to the article, the article being inserted between the laser and the support,
- locally illuminating the support through the article in conditions able to generate, at the surface of the support, sufficient thermal energy for the thermal energy transfer from the support to the article to generate at the surface of the article a local physical or chemical transformation, resulting in a contrast, generating the marking.

Owing to the use of a metal that is highly absorbent at a wavelength λ, for the support, and to the close thermal contact between the article to be marked and the support, a material transparent at wavelength λ, can be marked without any transfer of material or degradation of the support.

BRIEF DESCRIPTION OF THE DRAWING

Other features and advantages of the present invention will appear more clearly from the following detailed description of an example implementation according to the invention, this example being given purely by way of non-limiting illustration, in conjunction with the annexed drawings, in which.

DETAILED DESCRIPTION OF THE ILLUSTRATIVE EMBODIMENTS

Figure 1:
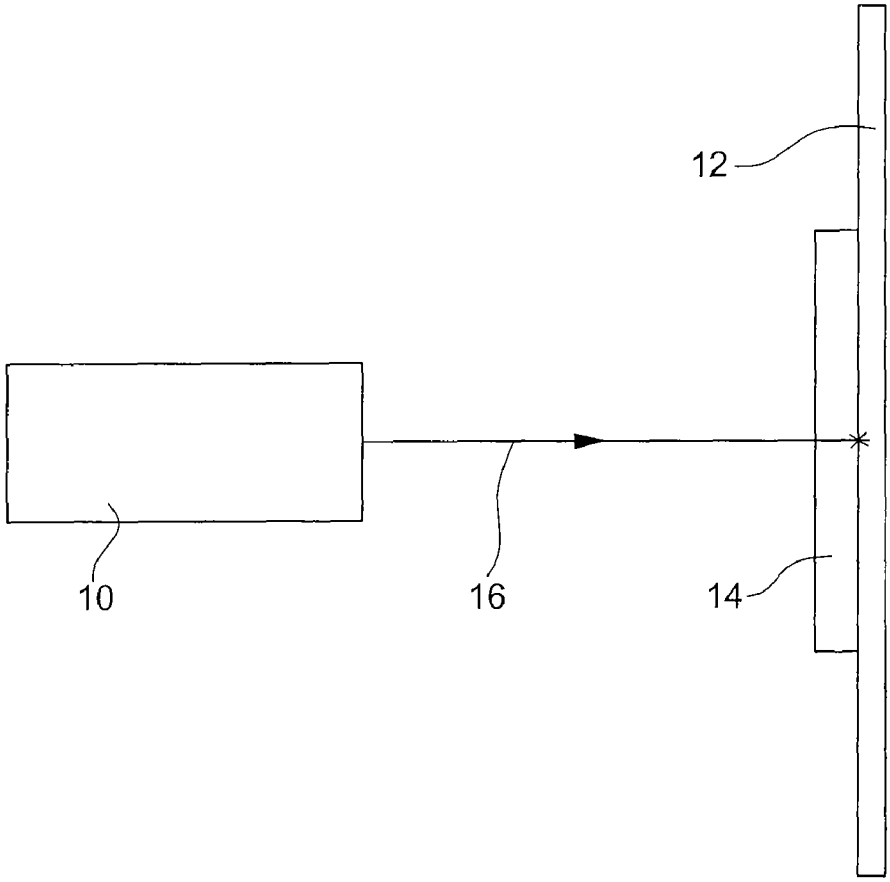
FIG. 1 is a schematic diagram of the installation used for the method according to the invention.

The installation shown in FIG. 1 comprises a Nd:YAG type laser emitting a ray at 1064 nm. In a variant, laser 10 could be a CO2 laser, emitting a ray in the remote infrared, at 10 microns. A support 12, formed of flat plate having a polished surface, is arranged on the path of the laser ray. Support 12 is made of metal, such as brass or aluminium, or any other material able to absorb highly the light ray emitted by the laser and to convert it into thermal energy.

An article 14 to be marked is arranged in contact with support 12, between support 12 and laser 10. Article 14 is a flat plate made of solid Plexiglas used as a support, for example. In a variant, article 14 could be formed of any other plastic material transparent at wavelength 1064 nm, for example, of polycarbonate or nylon. Article 14 could also have not be flat but have any other shape.

The thermal contact between support 12 and article 14 must be as good as possible, for reasons that will appear hereafter. Thus it is possible to press article 14 against support 12 using a clamp, or to arrange a solid object on article 14 for the same purpose. In the case of an article 14 that is not flat, support 12 has to be adapted to the shape of the latter, so as to optimise the thermal contact between the two elements.

Laser 10 emits radiation in the form of a beam 16 of wavelength 1064 nm in the direction of article 14. Beam 16 passes through Plexiglas plate 14 without being absorbed or being absorbed only slightly. Upon exiting plate 14, beam 16 strikes support 12 over a surface of the order of $2.10^{-9}$ $m^2$. Support 12 absorbs the radiation and transforms it into thermal energy. It then heats up locally to a temperature of the order of several tens to several hundreds of degrees Celsius. The thermal energy is transferred at least partially to article 14. Via the effect of this local input of thermal energy, the Plexiglas is locally transformed chemically, for example by carbonisation, or physically for example by melting. The two types of transformation can also occur simultaneously. The Plexiglas surface thereby transformed presents a contrast with the untreated surface, this contrast causing the marking of the Plexiglas.

The sweeping of a determined zone by laser beam 16 enables a barcode, a logo, an image or any other inscription to be marked.

What is claimed is:

1. A method of marking an article using a laser emitting radiation of wavelength λ, the article being formed of a material that is slightly absorbent at wavelength λ, wherein the method includes the following steps:

(a)—taking a support formed of a metal that is highly absorbent at wavelength λ and capable of converting at least in part the light energy absorbed into thermal energy;

(b)—arranging the article directly against the support so as to form a sufficient thermal contact between the article and the support to transfer the thermal energy from the support to the article, the article inserted between the laser and the support; and (c)—locally illuminating the support through the article with the laser emitting radiation of wavelength λ, in conditions being able to generate, at the surface of the support, sufficient thermal energy for thermal energy transfer from the support to the article, wherein the thermal energy transfer produces, on a surface of the article, a local physical transformation or a local chemical transformation, wherein a marking is obtained, without any transfer of material of the support or any degradation of the support, by the local physical transformation or the local chemical transformation of the article, which results in a contrast at the origin of the marking.

2. The marking method according to claim 1, wherein the laser is a Nd:YAG laser emitting radiation of wavelength λ equal to 1064 nm.

3. The method according to claim 1, wherein the metal is brass.

4. The method according to claim 1, wherein the metal is aluminium.

* * * * *